US007089609B2

(12) United States Patent
Jannetides

(10) Patent No.: US 7,089,609 B2
(45) **Date of Patent: *Aug. 15, 2006**

(54) MULTIPLE BED UNIT AND SUB-ASSEMBLY AND METHOD OF ASSEMBLY

(75) Inventor: James N. Jannetides, Fishers, IN (US)

(73) Assignee: J Squared, Inc. d/b/a University Loft Company, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/327,891

(22) Filed: Jan. 9, 2006

(65) Prior Publication Data

US 2006/0107457 A1 May 25, 2006

Related U.S. Application Data

(63) Continuation of application No. 10/824,764, filed on Apr. 14, 2004, now Pat. No. 6,983,494.

(60) Provisional application No. 60/463,459, filed on Apr. 15, 2003, provisional application No. 60/464,365, filed on Apr. 18, 2003.

(51) Int. Cl.
*A47C 19/02* (2006.01)
*A47C 19/22* (2006.01)

(52) U.S. Cl. ..... 5/8; 5/9.1; 5/2.1; 5/425

(58) Field of Classification Search ..... 5/425, 5/427, 428, 2.1, 8, 9.1, 201, 285, 286, 296
See application file for complete search history.

(56) References Cited

U.S. PATENT DOCUMENTS

| | | | | |
|---|---|---|---|---|
| 2,557,538 | A * | 6/1951 | Greensfelder | 5/425 |
| 2,664,576 | A * | 1/1954 | Lehman | 5/425 |
| 3,011,180 | A | 12/1961 | Majeski | |
| 3,316,564 | A * | 5/1967 | Rogers, Jr. | 5/9.1 |
| 4,109,328 | A * | 8/1978 | Mason | 5/2.1 |
| 4,189,796 | A | 2/1980 | Gutner | |
| 4,221,012 | A | 9/1980 | Harris | |

(Continued)

OTHER PUBLICATIONS

Photograph, circa 1984, from University Loft Company website [retrieved Jun. 24, 2005]. Retrieved from the Internet: http://www.universityloft.com/NewSite/prototype.asp?line=About%20Us&category=Company%20History.

(Continued)

*Primary Examiner*—Michael Trettel
(74) *Attorney, Agent, or Firm*—William F. Bahret; P. Derek Pressley

(57) ABSTRACT

A sub-assembly for a multiple bed unit having an elongate bed rail and a bed end including a pair of spaced, substantially vertical posts affixed to a side of the bed rail. Each of the posts includes a rail connector for receiving a rail of another bed. A multiple bed unit includes a first bed having a pair of bed ends, a side rail and a sub-assembly connected between and supported by the bed ends, and a second bed having a bed end and at least one side rail connected between the bed end of the second bed and the bed end of the sub-assembly of the first bed.

16 Claims, 8 Drawing Sheets

U.S. PATENT DOCUMENTS

| | | | | |
|---|---|---|---|---|
| 4,232,411 | A | 11/1980 | Speyer | |
| 5,003,650 | A | 4/1991 | Caya | |
| 5,540,491 | A | 7/1996 | Wu | |
| 5,572,751 | A * | 11/1996 | Brandt | 5/9.1 |
| 5,829,074 | A | 11/1998 | Fisher | |
| D401,839 | S | 12/1998 | Krey et al. | |
| 6,018,829 | A | 2/2000 | Rosenquist | |
| 6,292,959 | B1 | 9/2001 | Rosenquist | |
| 6,314,595 | B1 | 11/2001 | Price | |
| 6,349,435 | B1 | 2/2002 | Mitchell | |
| 6,568,001 | B1 | 5/2003 | Walsh | |
| 6,925,665 | B1 * | 8/2005 | Hennings | 5/200.1 |
| 6,983,494 | B1 * | 1/2006 | Jannetides | 5/9.1 |
| 2005/0273929 | A1 * | 12/2005 | Hennings et al. | 5/201 |

OTHER PUBLICATIONS

Rockler Woodworking and Hardware, Bed and Futon Hardware [online], © 2005, 2 pages, [retrieved Oct. 11, 2005]; retrieved from the Internet: http://www.rockler.com/CategoryView.cfm?Cat_ID=141&filter=keyhole.

Rockler Woodworking and Hardware, Surface Mounted Keyhole Bed Rail Brackets, [online], © 2005, 2 pages, [retrieved Oct. 11, 2005]; retrieved from the Internet: http://www.rockler.com/ecom7/product_details.cfm?offerings_id=5783.

Rockler Woodworking and Hardware, Surface Mounted Keyhole Bed Rail Brackets (enlarged view), [online], c. 2005 1 page, [retrieved Oct. 11, 2005]; retrieved from the Internet: http://www.rockler.com/Rockler/images/32077-lg.jpg.

Dormitory Bed, undated; photographs taken at Miami University Nov. 6, 2005 (2 pages).

* cited by examiner

MULTIPLE BED UNIT AND SUB-ASSEMBLY AND METHOD OF ASSEMBLY

CROSS-REFERENCE TO RELATED APPLICATION

This application is a continuation of prior application Ser. No. 10/824,764, filed Apr. 14, 2004, now U.S. Pat. No. 6,983,494, that claims the benefit of U.S. Provisional Patent Application No. 60/463,459, filed Apr. 15, 2003, and U.S. Provisional Patent Application No. 60/464,365, filed Apr. 18, 2003, which applications are hereby incorporated by reference.

BACKGROUND OF THE INVENTION

This invention relates to bed frames and supports, and more particularly to modular multiple bed units.

In dorm rooms and other dwelling rooms having limited floor space in which more than one bed is to be placed, it is known to provide loft beds to elevate the mattresses above head level, thereby freeing valuable floor space for other purposes. It is also known to connect beds together at right angles at different levels, with one bed overlapping another. Examples of such prior art beds are shown in U.S. Pat. Nos. 6,568,001 to Walsh; 6,018,829 to Rosenquist; 5,572,751 to Brandt and 3,011,180 to Majeski.

SUMMARY OF THE INVENTION

One aspect of the present invention involves, in one embodiment, a bed rail and bed end assembly for a multiple bed unit that includes an elongate bed rail and a bed end including a pair of spaced, substantially vertical posts affixed to a side of the bed rail. Each of the posts includes a rail connector for receiving a rail of another bed.

Another aspect of the present invention involves a method of assembling a bed rail and bed end assembly for use with a multiple bed unit, including providing an elongate bed rail and providing a bed end having a pair of spaced, substantially vertical posts. Each of the posts includes a rail connector for receiving a rail of another bed. Each of the posts is affixed to a side of the bed rail such that the rail connector of the posts faces away from the bed rail.

Yet another aspect of the present invention involves a multiple bed unit with a first pair of bed ends having a sub-assembly connected between and supported by the bed ends. The sub-assembly includes a rail and a bed end affixed to a side of the rail. A first bed has a second pair of bed ends disposed below the first pair of bed ends and a pair of side rails connected between and supported by the bed ends. A second bed has a bed end and at least one side rail connected between and supported by the bed end of the second bed and the bed end of the sub-assembly. Another bed end is disposed below the bed end of the second bed to elevate the second bed.

A further aspect of the present invention involves an L-shaped loft bed with a first bed elevated at a level substantially above floor level having a pair of bed ends and a pair of side rails connected between the bed ends. A second bed connected substantially at a right angle to the first bed has a bed end and a pair of side rails connected thereto. One of the side rails has a second end connected to a side of one of the side rails of the first bed at substantially the same elevation as the side rail of the first bed. A vertical post is connected between the side of the side rail of the first bed and the second end of the side rail of the second bed.

An even further aspect of the present invention involves an L-shaped loft bed with a first bed having a pair of bed ends and a pair of side rails connected between and supported by the bed ends. A second bed has a bed end and a side rail connected thereto. The side rail of the second bed is connected at a right angle to a side of one of the side rails of the first bed. A guard rail for resting atop one of said side rails has a depending portion and a pair of horizontal rail pieces that are supported by the depending portion above the side rail in a predetermined, vertically spaced, parallel relationship.

A still further aspect of the present invention involves a multiple bed unit with a first bed having a pair of bed ends and a pair of side rails connected between and supported by the bed ends. A second bed has a bed end and a side rail with a first end connected to the bed end, and an opposing second end. A vertical post affixed to a side of one of the side rails of the first bed connects the second end of the side rail of the second bed at a right angle to the first bed, at an elevation substantially the same as the side rail of the first bed.

Other aspects and advantages of the present invention will be apparent from the following descriptions with reference to the drawings.

DETAILED DESCRIPTION OF THE PREFERRED EMBODIMENTS

Figure 1:
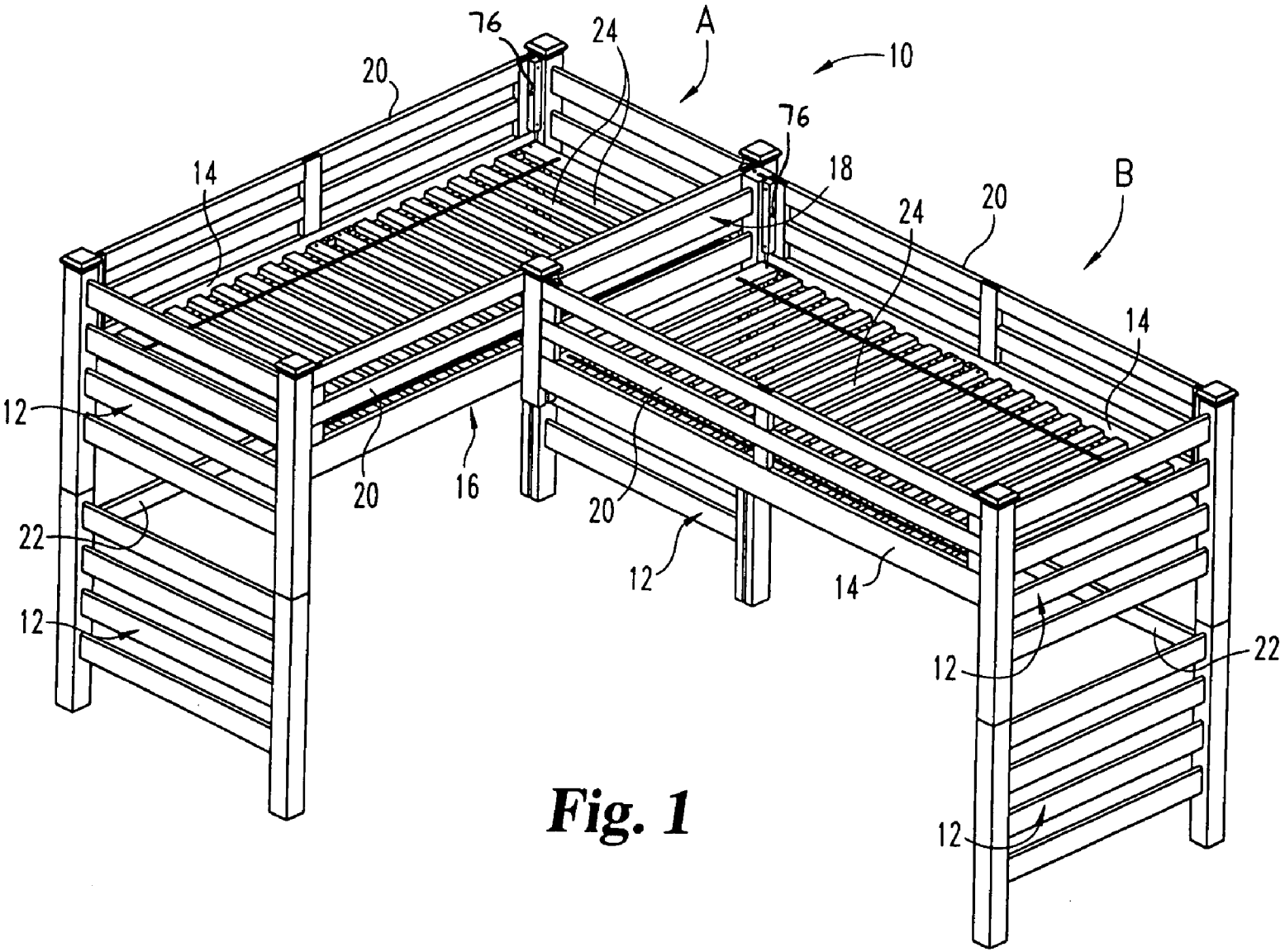
FIG. 1 is a perspective view of one embodiment of an assembled multiple bed unit according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 illustrates one embodiment of a modular multiple bed unit or loft bed 10 according to the present invention. Loft bed 10 is assembled from modular components of different types that may be interconnected in a variety of arrangements, of which loft bed 10 is only one example. The modular components include bed ends 12, side rails 14, sub-assembly 16 including conversion bed end 18, and guard rails 20. Sub-assembly 16 is used in place of a side rail 14 to convert beds into multiple bed units. Stabilizer rails 22 are also employed in some applications. Deck slats 24 provide support for a mattress, not shown.

Figure 2:
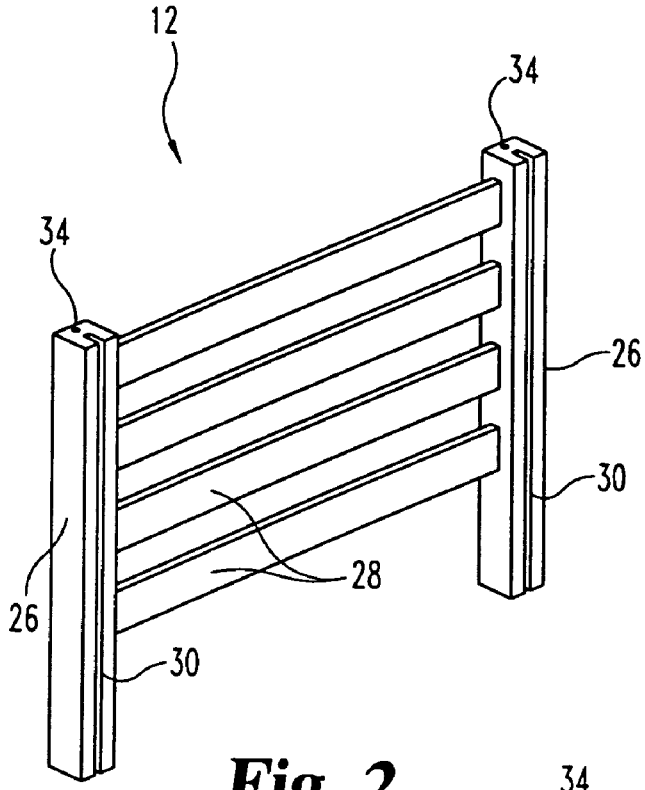
FIG. 2 is a perspective view of a bed end of the multiple bed unit of FIG. 1.
Figure 4:
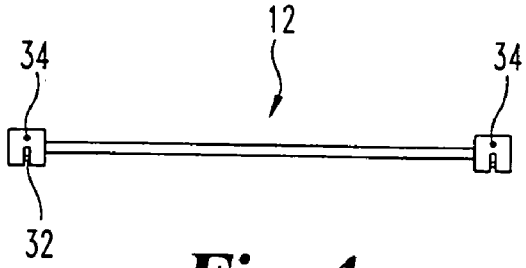
FIG. 4 is a top view of the bed end of FIG. 2.
Figure 3:
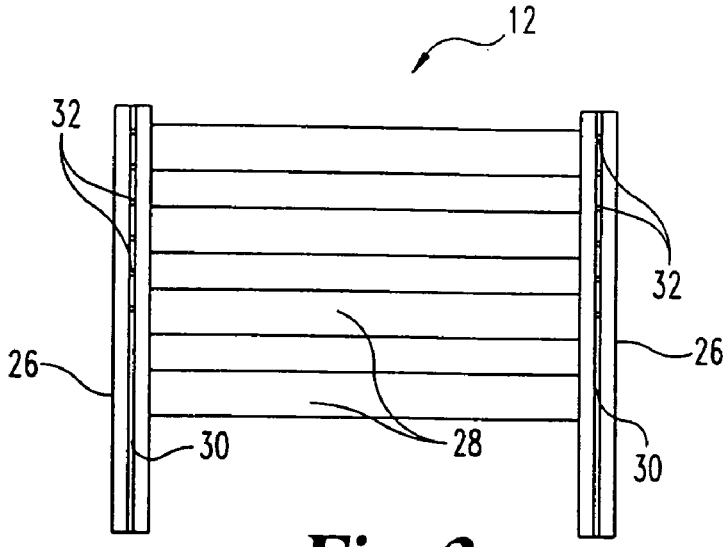
FIG. 3 is a front view of the bed end of FIG. 2.

With reference to FIGS. 2–4, bed end 12 includes a pair of spaced, substantially vertical posts 26, and a plurality of substantially horizontal cross-pieces 28. Each post 26 has a longitudinal slot 30 in one face running substantially the length thereof, with the slotted faces of both posts 26 of a given bed end 12 facing in the same direction. A plurality of metal cross-pins 32 are spaced vertically at substantially even intervals and extend substantially horizontally, bridging across slots 30. Slots 30 and cross-pins 32 comprise a rail connector for receiving a hook plate of a side rail as described below. A dowel-hole 34 is provided in each end of posts 26 for receiving a dowel therein to facilitate stacking of bed ends 12.

Figure 7:
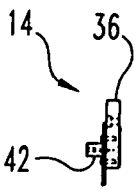
FIG. 7 is a right end view of the bed rail of FIG. 5.
Figure 6:
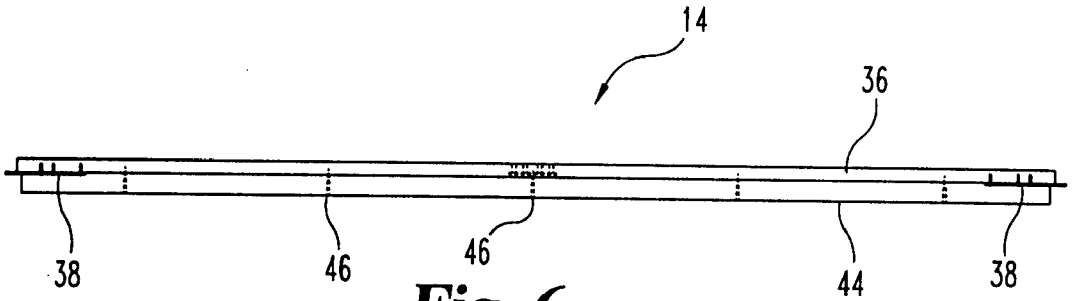
FIG. 6 is a top view of the bed rail of FIG. 5.
Figure 5:
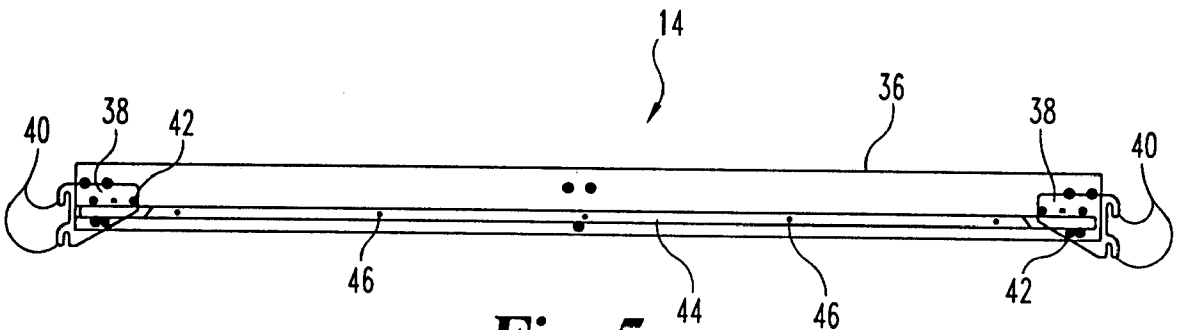
FIG. 5 is a side view of a bed rail of the multiple bed unit of FIG. 1.
Figure 8:
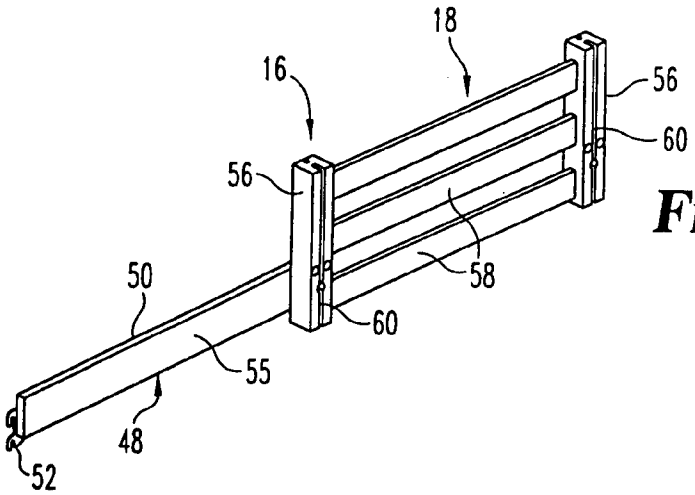
FIG. 8 is a perspective view of a sub-assembly of the multiple bed unit of FIG. 1.
Figure 10:
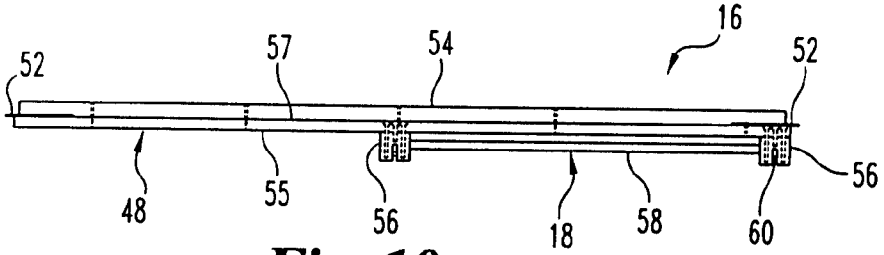
FIG. 10 is a top view of the sub-assembly of FIG. 8.
Figure 11:
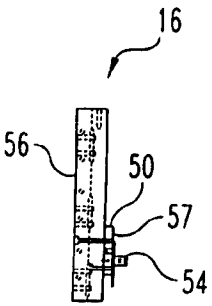
FIG. 11 is a right end view of the sub-assembly of FIG. 8.
Figure 9:
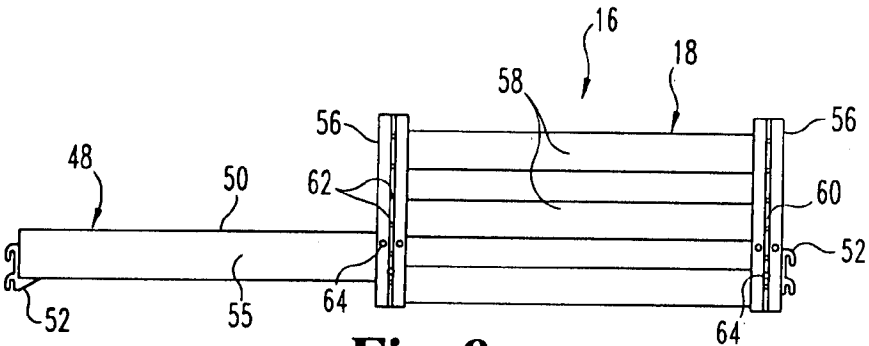
FIG. 9 is a side view of the sub-assembly of FIG. 8.

Referring to FIGS. 5–7, side rail 14 includes an elongate rail member 36 that may be about one inch wide by about 5 inches tall, with a length appropriate to accommodate a mattress of standard dimensions. Affixed to the inboard face 37 of rail member 36, at each end thereof, is a hook-plate 38 having a pair of downward opening spaced hooks 40 that may be received in slot 30 and over cross-pins 32 of bed ends 12. Hook-plate 38 is attached to rail member 36 by screw fasteners, preferably by way of a plurality of pan-head machine screws 42 received through corresponding holes in hook-plate 38 and threadedly received in threaded inserts imbedded in corresponding holes in rail member 36. Alternatively, wood screws or other suitable fasteners may be employed. An elongate support lip 44 is affixed with pan head wood screws 46 to the inboard face 37 of rail member 36 and runs substantially the length thereof to support deck slats 24. Lip 44 overlies hook-plates 38 and is rabbeted at each end to accommodate the thickness of plates 38.

Now referring to FIGS. 8–11, there is illustrated sub-assembly 16 which is particularly useful for converting beds into multiple bed units with the beds connected to one another at right angles. Sub-assembly 16 includes a bed rail 48 that is substantially similar to the above-described side rail 14, and includes an elongate rail member 50 that is substantially similar to the above-described rail member 36, and hook-plates 52 and support lip 54 that are substantially similar to the above-described hook-plates 38 and support lip 44.

Sub-assembly 16 differs from side rail 14 primarily in that a conversion bed end 18 is pre-assembled thereto on the outboard face 55 of rail member 50, opposite the inboard face 57 to which hook-plates 52 and support lip 54 are affixed. Conversion bed end 18 is somewhat similar to bed ends 12 described above, but is vertically shorter. Conversion bed end 18 includes a pair of spaced, substantially vertical posts 56, and a plurality of substantially horizontal cross-pieces 58. Each post 56 has a longitudinal slot 60 in one face running substantially the length thereof, with the slotted faces of both posts 56 facing in the same direction, i.e., in the outboard direction. A plurality of metal cross-pins 62 are spaced vertically at substantially even intervals as in bed ends 12, and extend substantially horizontally, bridging across slots 60. Posts 56 are attached to rail member 50 by a plurality of carriage bolts 64 and appropriate nuts and washers, received in holes that are countersunk at the inboard face of rail member 50 and the outboard faces of posts 56 so that the bolt ends do not protrude beyond the faces to cause mattress damage or bodily injury. The carriage bolts 64 of one of the posts 56, located proximate one end of rail member 50, are aligned with the hook plate 52. However, the carriage bolt ends, being countersunk in inboard face 57, do not interfere with or pass through hook plate 52, but rather are covered by hook plate 52.

Figure 12:
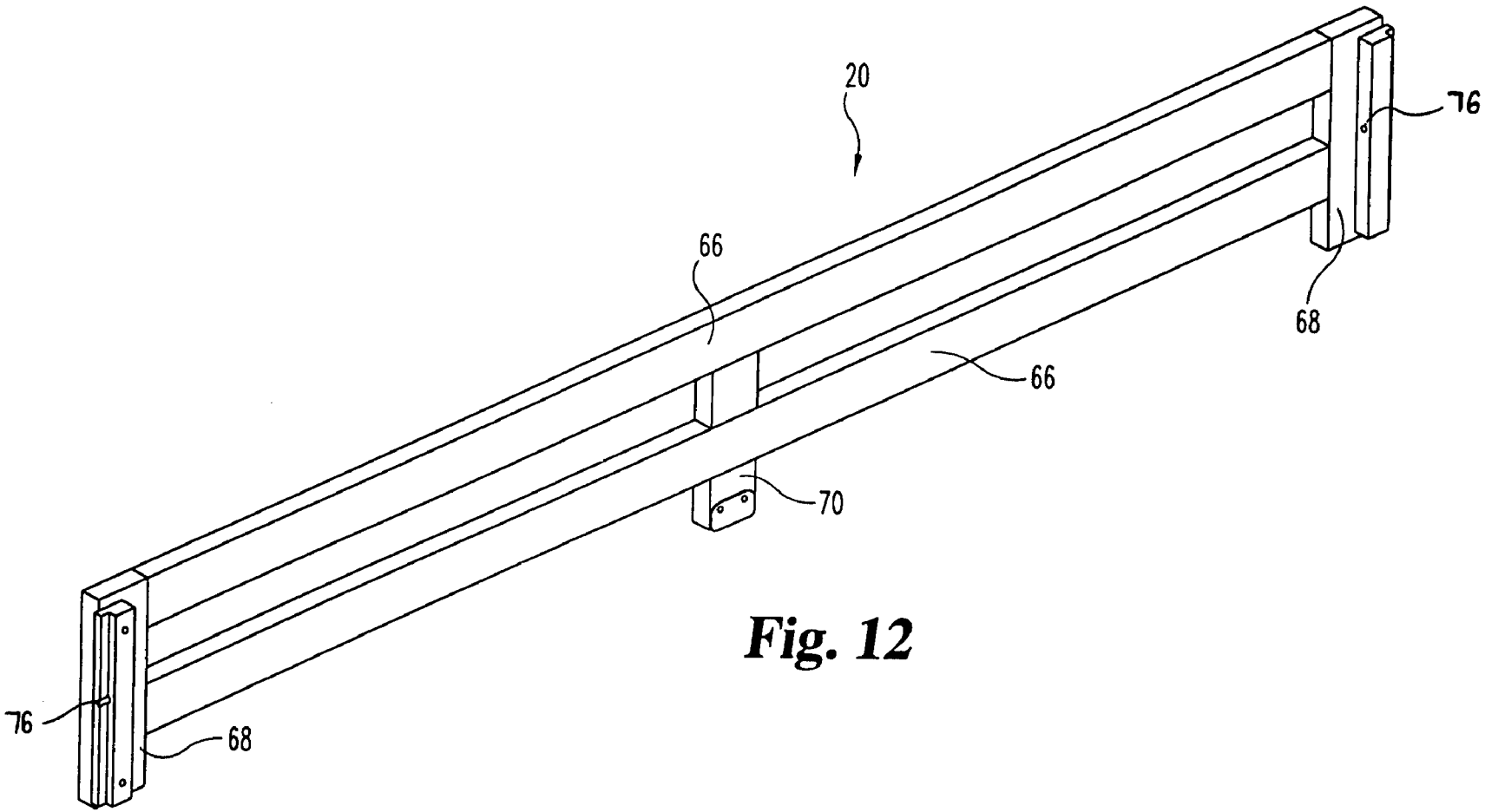
FIG. 12–12D are perspective views of a guard rail of the multiple bed unit of FIG. 1.
Figure 12A:
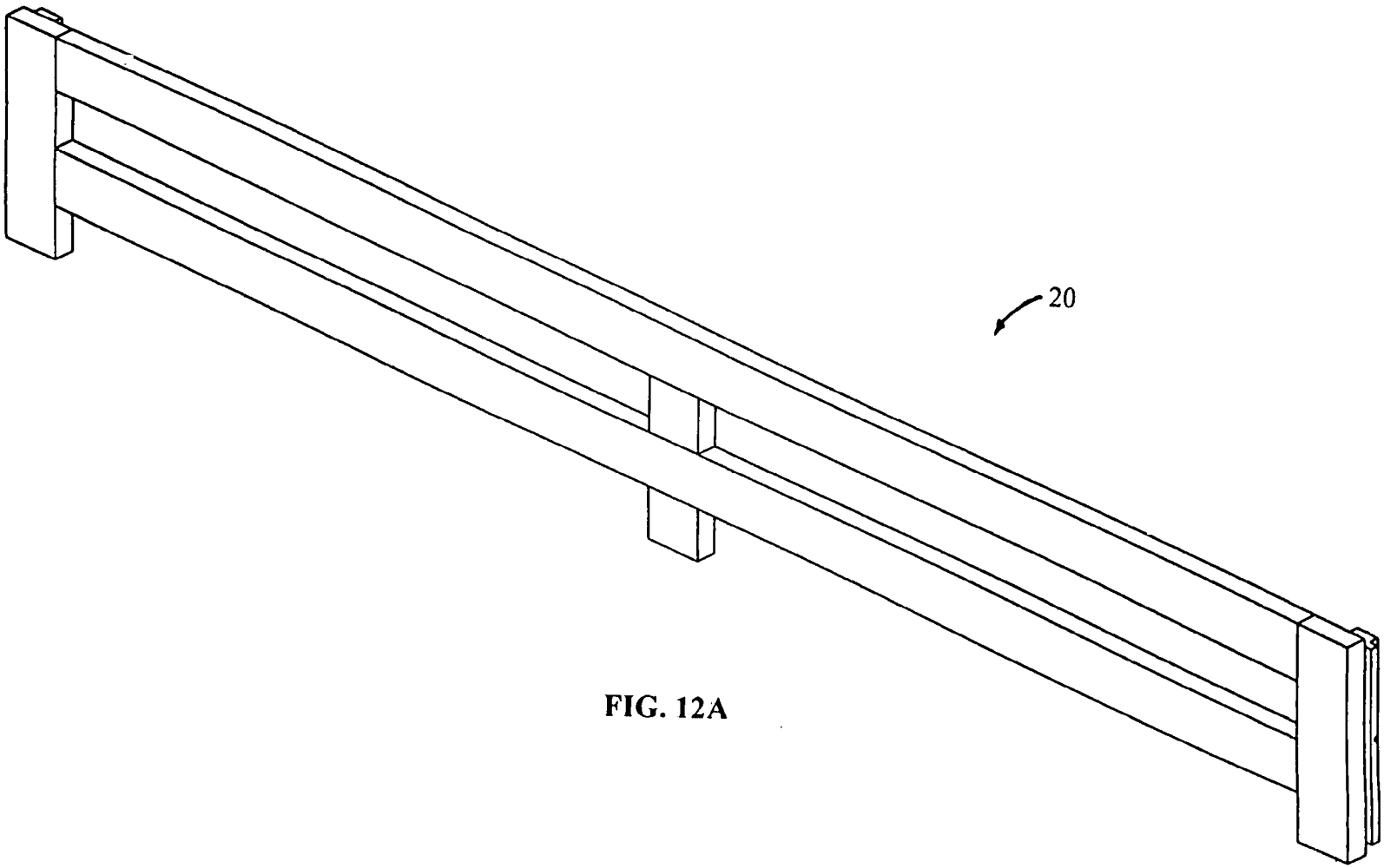
Figure 12B:
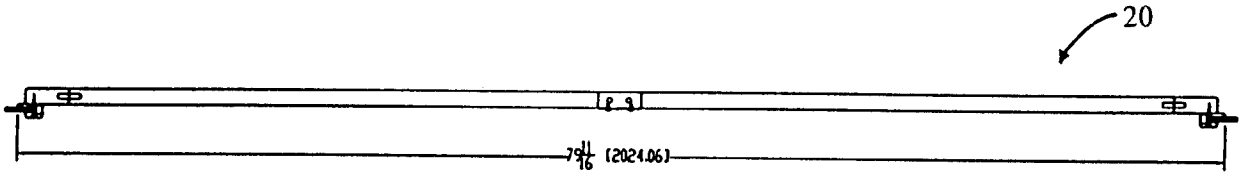
Figure 12C:
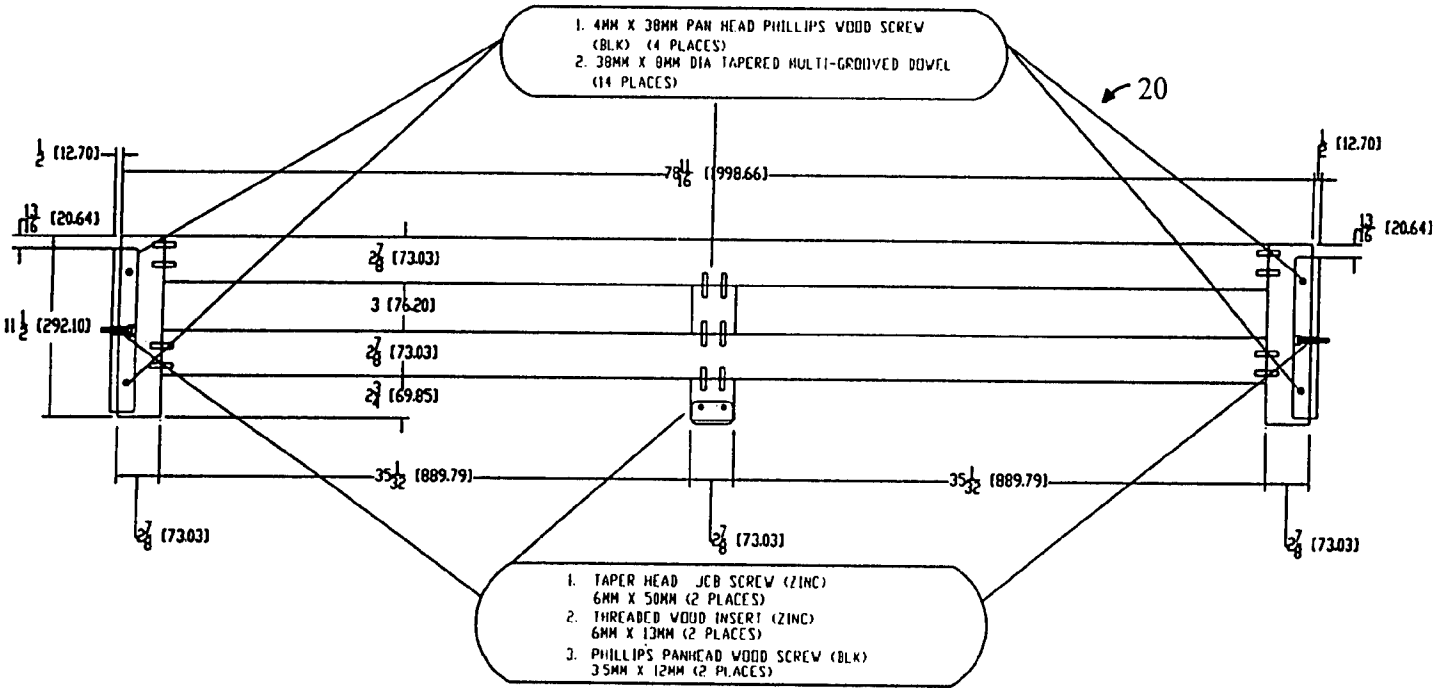
Figure 12D:
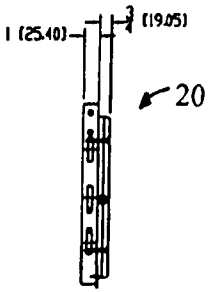

Referring to FIG. 12, a guard rail 20 is shown, including a pair of vertically spaced horizontal rail pieces 66, a pair of end pieces 68, a center brace 70, and a pair of slides 72, one affixed to each end piece 68. Slides 72 are rabbeted to provide a narrow vertical tongue 74 that can be received in any of the slots 30 of bed ends 12. Each slide 72 has a through hole 76 adjacent vertical tongue 74 that may be used to receive a threaded insert and a set screw (not shown). FIGS. 12A–12D show additional views of guard rail 20.

Referring again to FIG. 1, the various components described above are shown assembled to form a multiple bed unit having a first elevated bed A and a second elevated bed B connected to one another at right angles. First bed A is assembled by connecting stabilizer rail 22 to a first pair of opposite bed ends 12 that may stand on the floor for the purpose of elevating the bed. The slotted faces of the bed ends face inwardly toward each other. Stabilizer rail 22 is similar in construction to side rail 14 described above, and includes hook plates for engaging the cross-pins of bed ends 12, but does not include a support lip.

A side rail 14 and a sub-assembly 16 are connected to a second pair of opposite bed ends 12, with side rail 14 disposed on the inner side of the bed and the sub-assembly disposed on the outer side of the bed. As used herein in this context, "inner" and "outer" refer to the sides of the bed that may be adjacent and away from, respectively, a wall of the room. Dowels are placed in the holes 34 at the top of each post 26 of the floor-level bed ends, and the assembled bed A is raised and set upon the lower bed ends with the dowels being received in the holes in the bottom ends of the upper bed ends. The deck slats 24 are then placed on the support lips to span between inner side rail 14 and outer sub-assembly 16. The deck slats may be screwed to the support lips. Next, the guard rails 20 can be connected to inner and outer sides of bed A by sliding the tongues 74 downward in the slots 30 of the upper bed ends 12 so that guard rails 20 rest atop side rails 14. The position of guard rails 20 may then be fixed by tightening set screws within through holes 76 of slides 72 so that the set screws enter slots 30 below adjacent cross-pin 32, preventing movement of guard rails 20. That is, the relationship between side rails 14, guard rails 20 and posts 26 may be fixed to prevent users (children) from becoming entrapped between side rails 14 and guard rails 20.

Second bed B is assembled by stacking one bed end 12 above another, using dowels received in holes 34 of the respective bed ends. Then, a pair of side rails 14 are attached between the upper bed end 12 and the conversion bed end 18 of sub-assembly 16, thereby linking the stacked bed ends 12 to the first bed A. The hook plates 38 of side rails 14 engage the slots and cross-pins of conversion bed end 18 and upper bed end 12. The deck slats 24 are then placed on the support lips to span between inner and outer side rails 14. The deck slats may be screwed to the support lips. Next, the guard rails 20 can be connected to inner and outer sides of bed B by sliding the tongues 74 downward in the slots 30 of the upper bed end 12 and the slots 60 of the conversion bed end 18.

The multiple bed unit 10 of FIG. 1 may be made more useful by connecting a desk surface between the lower bed ends 12 of bed A. In lieu of a desk surface, a third bed may be added by connecting another pair of side rails between the lower bed ends 12 of bed A, with additional bed slats 24 spanning between the side rails. In addition, a fourth bed may be added by substituting a sub-assembly 16 for one of the side rails 14 of bed B, and connecting thereto another pair of side rails and a bed end, with an additional bed end below to elevate the fourth bed. Other combinations of multiple beds are possible by replacing a side rail 14 with a sub-assembly 16 by which an additional bed may be connected at a right angle to an existing bed.

Figure 13:
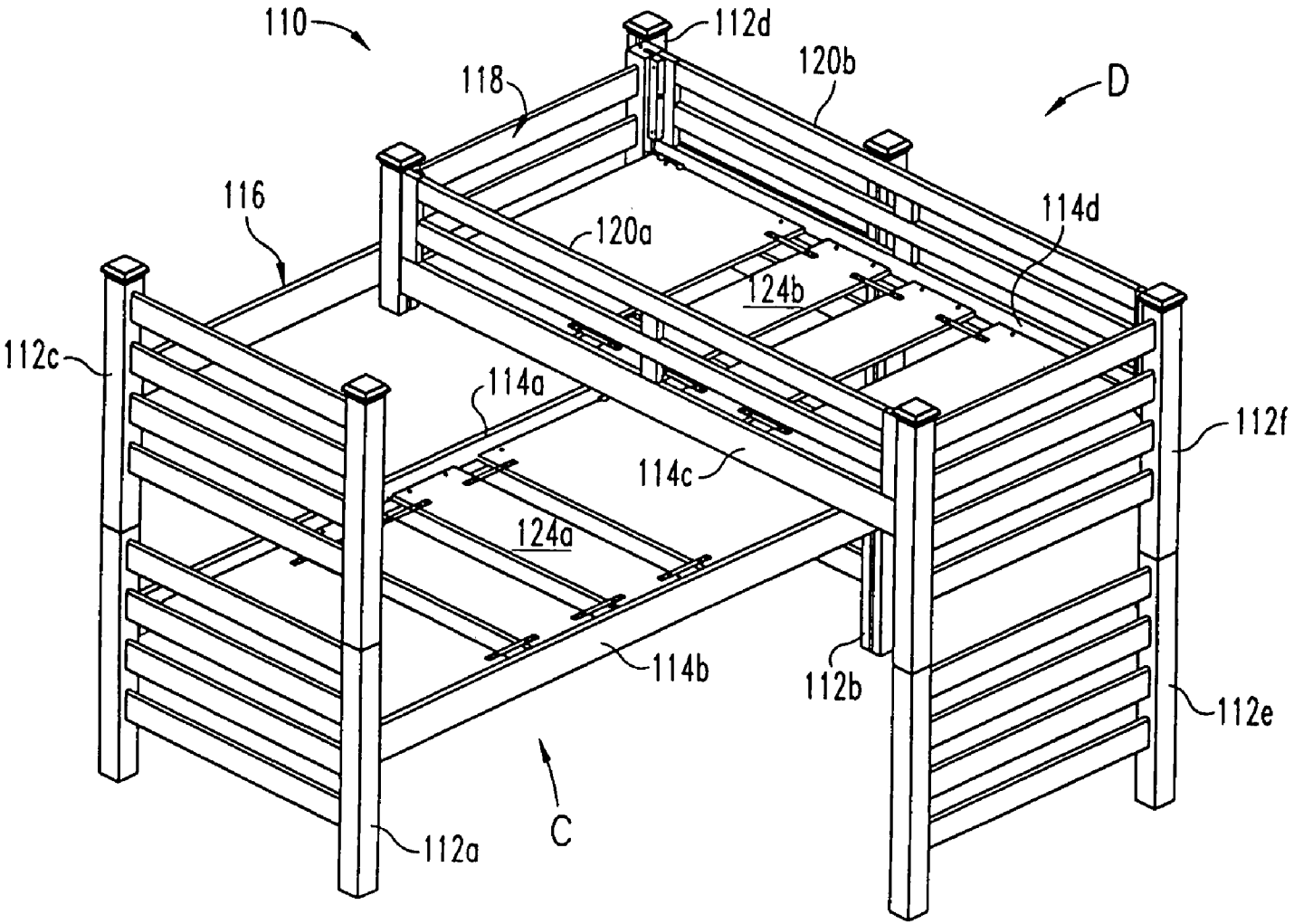
FIG. 13 is a perspective view of another embodiment of a multiple bed unit according to the present invention.

Referring to FIG. 13, another embodiment of a multiple bed unit 110 of the present invention is shown in which a second bed D is elevated above and crosses over a first bed C at a right angle. Letter suffixes are appended to the reference numerals to distinguish components that are otherwise identical, but differ only by location in the assembled bed.

First bed C is assembled by erecting a pair of opposite bed ends 112*a* and 112*b* that are connected by an inner side rail 114*a* and an outer side rail 114*b*. The deck slats 124*a* are then placed on the support lips to span between inner and outer side rails 114*a* and 114*b*. A second pair of bed ends 112*c* and 112*d* are stacked atop bed ends 112*a* and 112*b*, respectively, using dowels as described previously. A sub-assembly 116 is connected between upper bed ends 112*c* and 112*d* on the inner side of the bed C. In this configuration, sub-assembly 116 is disposed so that the previously described "outboard" side of the rail, i.e., the side to which the conversion bed end 118 is affixed, faces inwardly of bed C.

Second bed D is assembled by stacking two bed ends 112*e* and 112*f*, and connecting a pair of side rails 114*c* and 114*d* between upper bed end 112*f* and conversion bed end 118. The deck slats 124*b* are then placed on the support lips to span between inner and outer side rails 114*c* and 114*d*. Next, the guard rails 120*a* and 120*b* can be connected to inner and outer sides of bed D by sliding the tongues downward in the slots of the upper bed end 112*f* and the slots of the conversion bed end 118.

A variation of the embodiment of FIG. 13 may be assembled by connecting the sub-assembly 116 between lower bed ends 112*a* and 112*b*, and connecting side rails 114*a* and 114*b* between upper bed ends 112*c* and 112*d*. Side rails 114*c* and 114*d* may be connected to conversion bed end 118 and bed end 112*f* as before, without bed end 112*e*. Consequently, bed C may be elevated above bed D.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An L-shaped loft bed, comprising:

a first bed elevated at a level substantially above floor level having a pair of bed ends and a pair of side rails connected between said bed ends;

a second bed connected substantially at a right angle to said first bed, said second bed having a bed end and a pair of side rails connected thereto, at least one of said side rails having an end connected to a side of one of said side rails of said first bed, at substantially the same elevation as said side rail of said first bed; and a vertical post connected between said side of said side rail of said first bed and said end of said side rail of said second bed.

2. The L-shaped loft bed of claim 1, wherein said vertical post extends above said side rails of said first and second beds.

3. The L-shaped loft bed of claim 2, further comprising a guard rail extending between said vertical post and said bed end of said second bed.

4. The L-shaped loft bed of claim 3, wherein said guard rail comprises a depending portion supporting said guard rail above said side rail of said second bed that is connected to said side of one of said side rails of said first bed.

5. An L-shaped loft bed, comprising:

a first bed having a pair of bed ends and a pair of side rails connected between and supported by said bed ends;

a second bed having a bed end and a side rail connected thereto, said side rail connected at a right angle to a side of one of said side rails of said first bed; and a guard rail for resting atop one of said side rails, said guard rail having a depending portion and a pair of horizontal rail pieces that are supported by said depending portion above said side rail in a predetermined, vertically spaced, parallel relationship.

6. The L-shaped loft bed of claim 5, wherein said side rail of said second bed is connected to said side of said side rail of said first bed at substantially the same elevation as said side rail of said first bed.

7. The L-shaped loft bed of claim 5, wherein said bed ends of said first and second beds each have rail connectors; and said guard rail includes a vertically extending tongue for insertion into a rail connector of one of said bed ends.

8. The L-shaped loft bed of claim 7, wherein said guard rail further comprises a means for fixing a relationship between said guard rail and said side rail.

9. The L-shaped loft bed of claim 8, wherein said means for fixing a relationship between said guard rail and said side rail comprises a set screw that engages said rail connector.

10. A multiple bed unit, comprising:

a first bed having a pair of bed ends and a pair of side rails connected between and supported by said bed ends;

a second bed having a bed end and a side rail, said side rail having a first end connected to said bed end and an opposing second end; and a vertical post affixed to a side of one of said side rails of said first bed and connecting said second end of said side rail of said second bed at a right angle to said first bed, at an elevation substantially the same as said side rail of said first bed.

11. The multiple bed unit of claim 10, wherein said vertical post extends above said side rails of said first and second beds, further comprising:

a guard rail secured above said side rail of said second bed by said bed end of said second bed and said vertical post.

12. The multiple bed unit of claim 11, wherein said guard rail comprises a pair of horizontal rail pieces.

13. The multiple bed unit of claim 12, wherein said guard rail further comprises a depending portion supporting said horizontal rail pieces above said side rail in a predetermined vertically spaced, parallel relationship.

14. The multiple bed unit of claim 13, wherein said vertical post has a rail connector; and said guard rail includes a vertically extending tongue for insertion into said rail connector, and a means for fixing a relationship between said guard rail and said side rail.

15. An L-shaped loft bed, comprising:

a first bed elevated at a level substantially above floor level having a pair of bed ends and a pair of side rails connected between said bed ends;

a second bed connected substantially at a right angle to said first bed, said second bed having a bed end and a pair of side rails connected thereto, at least one of said side rails having an end connected to a side of one of said side rails of said first bed, with at least a portion of each of said rails at to same level; and a rail connector member having a slot and a cross-pin, connected between said side of said side rail of said first bed and said end of said side rail of said second bed.

16. A multiple bed unit, comprising:

a first bed having a pair of bed ends and a pair of side rails connected between and supported by said bed ends;

a second bed having a bed end and a side rail, said side rail having a first end connected to said bed end and an opposing second end; and a rail connector member having a slot and a cross-pin, affixed to a side of one of said side rails of said first bed and connecting said second end of said side rail of said second bed at a right angle to said first bed, at an elevation substantially the same as said side rail of said first bed.

* * * * *